US010350483B1

(12) United States Patent
Basyuk

(10) Patent No.: US 10,350,483 B1
(45) Date of Patent: Jul. 16, 2019

(54) PUZZLE AND A METHOD OF MAKING THEREOF

(71) Applicant: Simon Basyuk, Millburn, NJ (US)

(72) Inventor: Simon Basyuk, Millburn, NJ (US)

( * ) Notice: Subject to any disclaimer, the term of this patent is extended or adjusted under 35 U.S.C. 154(b) by 12 days.

(21) Appl. No.: 15/447,872

(22) Filed: Mar. 2, 2017

Related U.S. Application Data

(60) Provisional application No. 62/306,086, filed on Mar. 10, 2016.

(51) Int. Cl.
*A63F 9/10* (2006.01)
*A63F 9/06* (2006.01)

(52) U.S. Cl.
CPC ..... *A63F 9/0613* (2013.01); *A63F 9/10* (2013.01)

(58) Field of Classification Search
CPC .... A63F 2009/0615; A63F 2009/01616; A63F 2009/01618; A63F 2009/0619; A63F 2009/062; A63F 9/10
See application file for complete search history.

(56) References Cited

U.S. PATENT DOCUMENTS 636,319 A * 11/1899 Camp ..... B32B 17/06 428/13
2,151,055 A * 3/1939 Stark ..... B44F 7/00 273/157 A
2,911,220 A * 11/1959 Irwin ..... A63F 1/02 273/155
3,046,686 A * 7/1962 Fogle ..... B21B 38/10 156/280
3,245,687 A * 4/1966 Irwin ..... A63F 1/02 273/157 A
3,645,534 A * 2/1972 Weisbecker ..... A63F 9/12 273/155
3,682,479 A * 8/1972 Miller ..... A63F 9/12 273/157 R
4,362,301 A * 12/1982 Duveyoung ..... A63F 9/0613 273/157 A
4,430,824 A * 2/1984 Yamamoto ..... A63F 9/0613 273/157 A
4,815,742 A * 3/1989 Augustine ..... A63F 9/0613 273/157 A
5,037,110 A * 8/1991 Haskel ..... A63F 1/00 273/157 A
5,221,094 A * 6/1993 Hanson ..... A63F 9/18 273/431
5,299,805 A * 4/1994 Green ..... A63F 9/0613 273/157 A
5,577,728 A * 11/1996 Kondo ..... A63F 9/0613 273/157 A (Continued)

*Primary Examiner* — Steven B Wong
(74) *Attorney, Agent, or Firm* — Lawrence G. Fridman, Esq.; Feigin & Fridman, LLC

(57) ABSTRACT

A puzzle including a background puzzle surface having printed thereon a background puzzle image including image areas and blank areas, and at least one puzzle piece formed of a transparent material having printed thereon a puzzle piece image including image areas and blank transparent areas. When solving the puzzle, the at least one puzzle piece is superimposed over the background puzzle surface, and is moved thereon to a correct location in which the image areas of the background puzzle image together with the image areas of the puzzle piece image match and form a cohesive image.

19 Claims, 10 Drawing Sheets

(56) References Cited

U.S. PATENT DOCUMENTS

| | | | | |
|---|---|---|---|---|
| 5,769,418 | A * | 6/1998 | Gilbert | A63F 9/0613<br>273/153 S |
| 5,823,532 | A * | 10/1998 | Goldwasser | A63F 9/1044<br>273/157 R |
| 6,361,045 | B1 * | 3/2002 | Bernstein | A63F 9/10<br>273/157 A |
| 2002/0043760 | A1 * | 4/2002 | Gallant | A63F 9/10<br>273/157 R |
| 2011/0042893 | A1 * | 2/2011 | Someya | A63F 9/10<br>273/157 R |
| 2013/0154188 | A1 * | 6/2013 | Burrows | A63F 9/10<br>273/157 R |

* cited by examiner

PUZZLE AND A METHOD OF MAKING THEREOF

FIELD AND BACKGROUND OF THE DISCLOSED TECHNOLOGY

The disclosed technology relates generally to games and, more specifically, to a puzzle and to a method of making thereof.

U.S. Pat. No. 8,397,412 to Rosenbaum et al is directed to a system and method of mounting an image composed of a plurality of subimages, the system includes a back panel onto which the subimages are mounted, and a transparent or translucent cover plate.

U.S. Pat. No. 5,769,418 to Gilbert et al is directed to a tile slide puzzle which has a transparent top layer of sliding tiles and a bottom layer of sliding tiles, which can be seen through the top layer. The top layer is provided with a top image and the bottom layer is provided with a bottom image which is associated with the top image. When viewed through the transparent top layer both top and bottom layers are viewed as a composite image. The two layers of tile slides are all disposed in a base, which does not form part of the puzzle.

U.S. Pat. No. 4,815,742 to Augustine is directed to a multi-layered three dimensional puzzle having a plurality of generally transparent layers, with each layer having different designs thereon. The puzzle is solved by matching shape designs of each piece and identifying the appropriate layer in the puzzle.

U.S. Pat. No. 4,799,680 is directed to a puzzle comprising a base formed from a transparent material and including a generally planar bottom wall and a frame extending upwardly to define a puzzle recess. The puzzle also includes a plurality of transparent puzzle pieces dimensioned to be received within the puzzle recess. The base and pieces can be used to trace an image with a suitable marker, thereby to form a puzzle.

SUMMARY OF THE DISCLOSED TECHNOLOGY

The disclosed technology relates generally to games and, more specifically, puzzles and methods of making thereof.

According to an embodiment of the teachings herein, there is provided a method for creating a puzzle, the method including:

obtaining a source image;

dividing the source image into a plurality of adjacent sections each including a portion of the source image;

dividing the plurality of sections into first and second groups of sections;

generating a background puzzle image, the background puzzle image including image areas corresponding to portions of the source image included in sections of the first group of sections and blank areas corresponding to sections of the second group of sections;

generating a foreground puzzle image, the foreground puzzle image including image areas corresponding to portions of the source image included in sections of the second group of sections and blank areas corresponding to sections of the first group of sections;

generating at least one puzzle piece image by selecting at least one region on the foreground puzzle image as the at least one puzzle piece image;

creating a background puzzle surface having the background puzzle image provided thereon; and creating, from a transparent material, at least one puzzle piece having the at least one puzzle piece image provided thereon wherein the blank areas of puzzle piece image provide transparent areas in the at least one puzzle piece, wherein when the at least one puzzle piece is placed overlying the background puzzle surface in a particular location with a particular orientation, the puzzle piece image together with the image areas of the background puzzle image on the background puzzle surface, visible through the transparent areas in the at least one puzzle piece, form an image generally identical to a portion of the source image.

the background puzzle surface has background puzzle surface dimensions, and wherein the generating at least one puzzle piece comprises generating each of the at least one puzzle piece to have dimensions at least two times smaller than the background puzzle surface dimensions.

In some embodiments, creating the background puzzle surface comprises providing the background puzzle image on a surface of a flat sheet.

In some embodiments, the creating the at least one puzzle piece comprises creating the at least one puzzle piece from a transparent sheet having the at least one puzzle piece image on at least one surface thereof.

In some embodiments, creating the at least one puzzle piece comprises creating the at least one puzzle piece having on the at least one surface an adhesive layer.

In some embodiments, generating the background puzzle image comprises filling the blank areas of background puzzle image with a predetermined color or a predetermined pattern.

In some embodiments, creating the at least one puzzle piece comprises creating the at least one puzzle piece from a transparent sheet having a mirror-reversed copy of the at least one puzzle piece image on at least one surface of the at least one puzzle piece, thereby, when looked through the opposite surface of the at least one puzzle piece, the image appears as the at least one puzzle piece image.

According to another embodiment of the teachings herein, there is provided a puzzle including:

a background puzzle surface having a background puzzle image provided thereon, the background puzzle image including image areas corresponding to specific sections of a source image and blank areas corresponding to complementary sections of the source image which are complementary to the specific sections; and at least one puzzle piece formed from a transparent material, the at least one puzzle piece having at least one puzzle piece image provided thereon, the at least one puzzle piece image corresponding to at least one region on the source image and including image areas corresponding to the complementary sections of the source image in the region and transparent areas corresponding to the specific sections of the source image in the region, wherein when the at least one puzzle piece is placed overlying the background puzzle surface in a particular location with a particular orientation, the at least one puzzle piece image together with the image areas of the background puzzle image on the background puzzle surface, visible through the transparent areas in the at least one puzzle piece, form an image generally identical to a portion of the source image.

In some embodiments, the background puzzle surface is a surface of a flat sheet.

In some embodiments, the at least one puzzle piece is made from a transparent sheet having the at least one puzzle piece image on at least one surface thereof.

In some embodiments, the at least one puzzle piece has at least one surface including an adhesive layer.

According to yet another embodiment of the teachings herein, there is provided a device for displaying a puzzle, including:

a display screen;

a processor associated with the display screen and configured to receive input from a user; and a non-transitory computer readable storage medium for instructions execution by the processor, the non-transitory computer readable medium having stored:

instructions to display on the display screen a background puzzle image including image areas corresponding to specific sections of a source image and blank areas corresponding to complementary sections of the source image which are complementary to the specific sections;

instructions to display on the display screen at least one puzzle piece image corresponding to at least one region on the source image and including as image areas thereof the complementary sections of the source image in the region, and blank areas corresponding to the specific sections in the region;

instruction to position of the at least one puzzle piece image and the background puzzle image on the display in accordance with input received from the user by the processor so that the at least one of the background puzzle image and the at least one puzzle piece image may superimpose; and instructions, to be carried out when the at least one puzzle piece image is superimposed over the background puzzle image, to display on the display screen in the region of superimposition: the image areas of the at least one puzzle piece image and portions of the background image over which the blank areas of the at least one puzzle piece image are superimposed, wherein when the at least one puzzle piece is placed in a particular location with a particular orientation superimposing the background puzzle image, the resulting image in the region of superimposition is generally identical to a particular portion of the source image.

In some embodiments, the display screen is a touch screen. In some embodiments, the device further includes a user input mechanism functionally associated with the processor, the user input mechanism adapted to receive user input from a user, and to transfer the user input to the processor as the input.

In some embodiments, the instructions to display the background image mask include instructions to display the blank areas of the puzzle background image filled with at least one of a predetermined color or a predetermined pattern.

In some embodiments, the non-transitory computer readable medium is connected to the processor via a data network, preferably via the Internet.

DETAILED DESCRIPTION OF EMBODIMENTS OF THE DISCLOSED TECHNOLOGY

In an embodiment of the disclosed technology, a puzzle is created by applying a mask to a source image thereby to form a background puzzle image which will be used as the background surface of the puzzle. A complementary mask is applied to the source image to form a foreground puzzle image, which is then divided into regions, each including a puzzle piece image having image areas and transparent areas. Each puzzle piece image is used to form a puzzle piece. In use, a puzzle piece is placed on the background surface of the puzzle such that areas of the background puzzle image are visible through the transparent areas of the puzzle piece. The puzzle piece needs to be positioned such that the image areas of the puzzle piece, together with areas of the background puzzle image visible through the transparent areas of the puzzle piece, form an image identical to a particular portion of the source image.

According to an aspect of some embodiments of the teachings herein, there is provided a method for creating a puzzle, the method including obtaining a source image, dividing the source image into a plurality of adjacent non-overlapping sections each including a portion of the source image, dividing the plurality of sections into first and second groups of sections, generating a background puzzle image, the background puzzle image including image areas corresponding to portions of the source image included in sections of the first group of sections and blank areas in portions of the source image included in sections of the second group of sections, generating a foreground puzzle image, the foreground puzzle image including image areas corresponding to portions of the source image included in sections of the second group of sections and blank areas in portions of the source image included in sections of the first group of sections, and generating at least one puzzle piece image by selecting at least one region of the foreground puzzle image as the puzzle piece image, wherein when the at least one puzzle piece image is placed overlying the background puzzle image in a particular orientation, image areas of the at least one puzzle piece image together with image areas of the background puzzle image form an image region identical to a region of the source image.

Embodiments of the disclosed technology will become clearer in view of the following description of the drawings.

Figure 1:
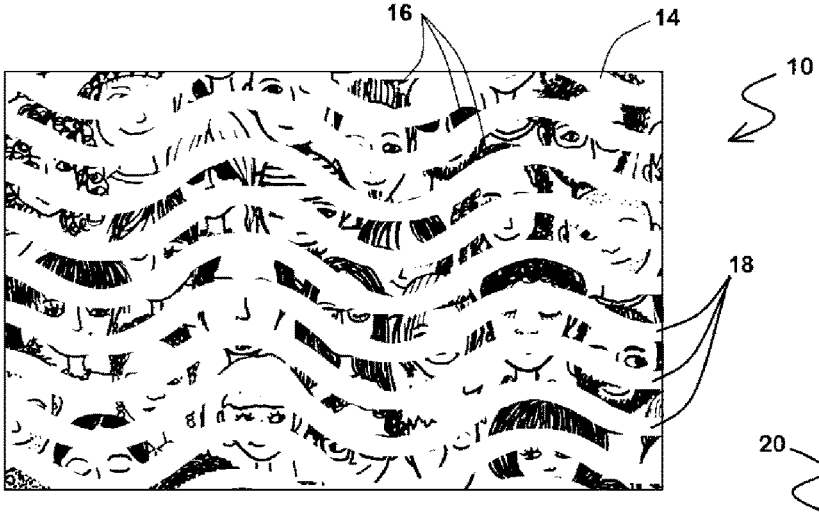
FIG. 1 is a top plan view of a background puzzle surface including a background puzzle image according to an embodiment of the disclosed technology.
Figure 4:
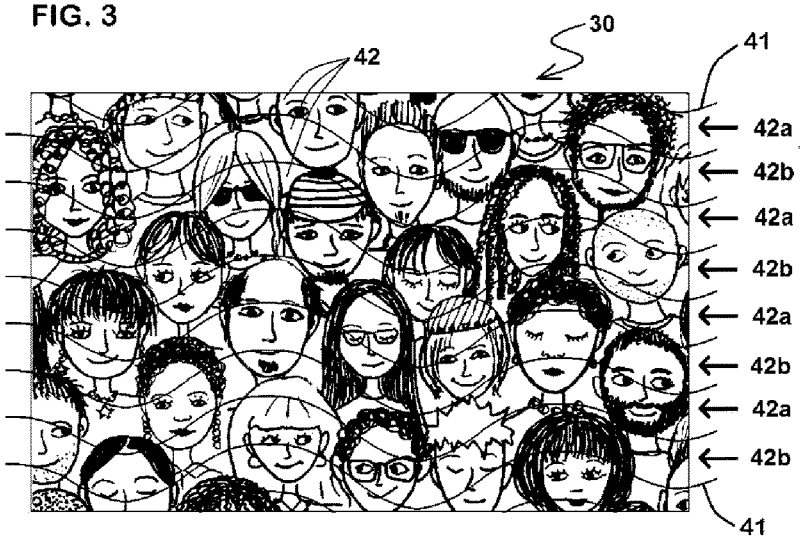
FIG. 4 illustrates the division of the source image of FIG. 3 into sections for generation of the background puzzle image of FIG. 1 and of the puzzle piece image of FIG. 2A.
Figure 5:
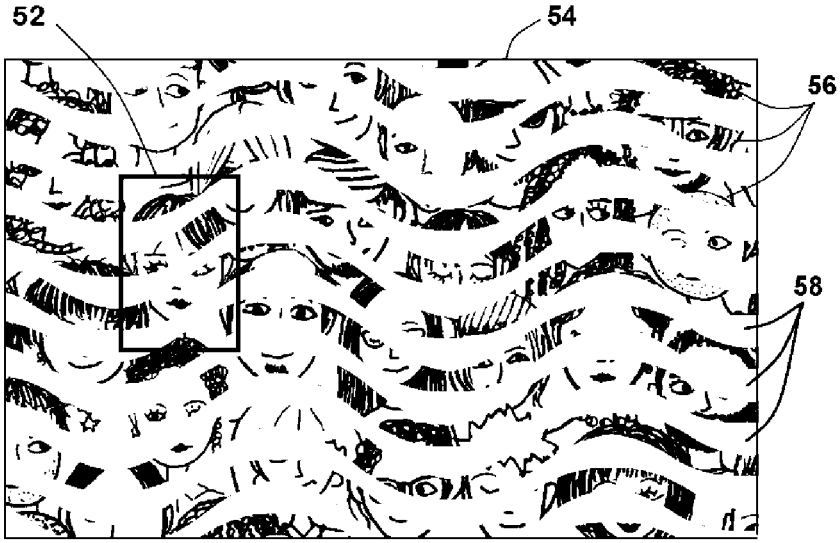
FIG. 5 illustrates a foreground puzzle image generated from the divided source image of FIG. 3 and used to generate the puzzle piece image of FIG. 2A.
Figure 6:
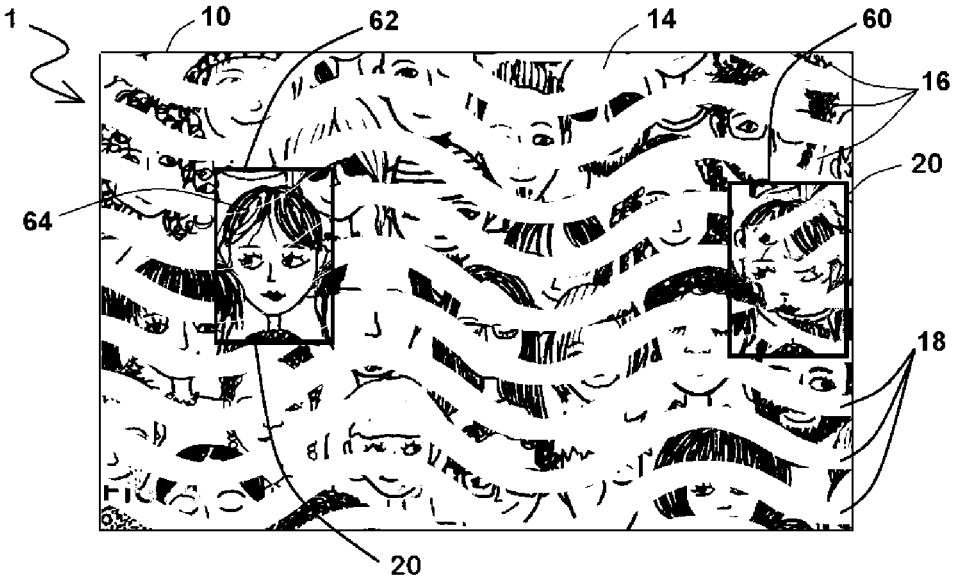
FIG. 6 illustrates the background puzzle surface of FIG. 1 with the puzzle piece of FIGS. 2A and 2B placed thereon.

Reference is now made to FIGS. 1 to 6, which illustrate one embodiment of the teachings herein. A puzzle 1 as illustrated in FIG. 6 according to the teachings herein includes a background puzzle surface 10, as illustrated in FIG. 1, and at least one puzzle piece 20, as illustrated in FIGS. 2A and 2B, each of which bears an image generated from a source image 30, illustrated in FIG. 3.

The background puzzle surface 10 has printed or otherwise disposed thereon a background puzzle image 14 including image areas 16 and blank areas 18, and is generated from source image 30 in accordance with a method described hereinbelow with reference to FIGS. 4 to 6. In some embodiments, the background puzzle surface 10 is made of cardboard or another similar opaque material.

The puzzle piece 20 is preferably formed of a transparent sheet and has printed or otherwise disposed thereon a puzzle piece image 24 including image areas 26 and transparent areas 28. As explained in further detail hereinbelow, the puzzle piece image is complementary to a portion of the background puzzle image, and is generated from the source image 30 in accordance with a method described hereinbelow with reference to FIGS. 4 to 6.

Figure 2A:
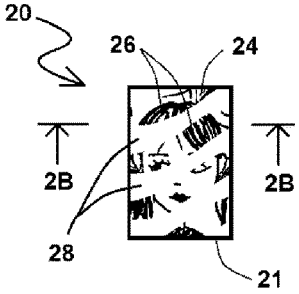
FIGS. 2A and 2B are, respectively, a top plan view and a cross sectional view of a puzzle piece including a puzzle piece image according to an embodiment of the disclosed technology.
Figure 2B:
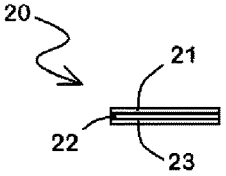

In some embodiments, such as that illustrated in cross sectional view in FIG. 2B, puzzle piece 20 includes a transparent sheet 21 and a low-tack adhesive layer 22 on a back surface thereof. The adhesive layer may be covered with a transparent removable protective film 23.

The puzzle piece image 24 is preferably printed or otherwise disposed onto one surface of transparent sheet 21, and may be disposed on the front surface or on the rear surface thereof. When disposing onto the rear surface of transparent sheet 21, the puzzle piece image 24 has to be mirror-reversed first, so that the image appearing through the material of transparent sheet 21 is actually the puzzle piece image 24.

In some embodiments, the puzzle piece need not have any type of adhesive layer and protective film whatsoever. In some such embodiments, the puzzle piece is sufficiently thick, for example formed of transparent plastic having a thickness in the range of 2-5 mm, and thus may rest securely on the background puzzle surface due to the weight of the puzzle piece. In other embodiments, the puzzle piece may be formed of a transparent electrostatic film which sticks to the background puzzle surface without needing an adhesive, or may attach to the background puzzle surface by suitably placed magnets or magnetic strips.

Figure 22:
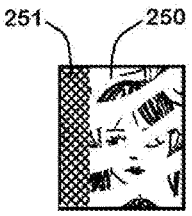
FIG. 22 illustrates an adhesive puzzle piece including a puzzle piece image according to the disclosed technology.

In some embodiments, the puzzle piece does not include adhesive layer 22 covering an entire surface thereof. In some embodiments, such as that illustrated in FIG. 22, a puzzle piece 250 may include a narrow adhesive strip 251 disposed on a rear surface thereof. A protective film, which may cover adhesive strip 251, may be formed of a non-transparent material, making the protective film easier to identify and remove.

It will be appreciated that though puzzle piece 20 is illustrated as a rectangular puzzle piece, puzzle pieces in accordance with the teachings herein, and puzzle piece images corresponding thereto, may assume any suitable shape, and need not necessarily be rectangular.

The source image 30 may be monochromatic or polychromatic, and may be of any suitable size and shape.

A method of creating a puzzle in accordance with the teachings herein is now described with respect to FIGS. 4 to 6. Turning to FIG. 4, it is seen that source image 30 is divided by lines 41 into a plurality of adjacent sections 42, such that the entire source image 30 is covered by sections 42. The sections 42 are then divided into a first group of sections, including sections indicated by reference numeral 42*a*, and a second group of sections including sections indicated by reference numeral 42*b*. The sections are mutually exclusive, such that there is no section that is included in both groups.

The sections 42 of the source image 30 are used to create the background puzzle image 14 illustrated in FIG. 1, such that areas of the background puzzle image corresponding to the sections 42*a* become image areas 16 which contents is a copy of the sections 42*a* contents. Areas of the background puzzle image 14 corresponding to sections 42*b* become blank areas 18 which contents is different from the contents of sections 42*b*. For instance, the blank areas 18 may be filled with white color, as illustrated in FIG. 1, or with any suitable color or a pattern. The background puzzle image 14 is disposed on the background puzzle surface 10, as described hereinabove.

The sections 42 of the source image 30 are used to create the foreground puzzle image 54 illustrated in FIG. 5, such that areas of the foreground puzzle image corresponding to the sections 42*b* become image areas 56 which contents is a copy of the sections 42*b* contents. Areas of the foreground puzzle image 54 corresponding to sections 42*a* become blank areas 58 where contents of corresponding sections 42*a* is blocked out. The blank areas 58 are preferably filled with white color, however may be filled with any suitable color.

The puzzle piece image 24 disposed onto transparent sheet 21 of the puzzle piece 20 illustrated in FIG. 2A is based on a region, or portion, of foreground puzzle image 54, indicated by reference numeral 52 in FIG. 5. Preferably, linear dimensions of the puzzle piece image 24 are at list two times smaller than linear dimensions of the background puzzle image 14. The puzzle piece image may be based on a rectangular region, as illustrated in FIG. 5, or on any other type or shape of region, as shown hereinbelow. In the puzzle piece image 24, the image areas 56 of the foreground puzzle image included within region 52 are copied directly, thereby forming image areas 26. By contrast, to form the transparent areas 28 of the puzzle piece, color is voided from blank areas 58 in region 52. As such, when the puzzle piece image is printed or otherwise disposed onto transparent sheet 21 of the puzzle piece 20, image areas 26 are colored, whereas transparent areas 28 are transparent. For instance, if a computerized printer is used for the purpose, it normally does not dispose the ink in white areas of the printing image.

In use, the puzzle piece 20 is initially positioned by a user at an initial location 60 on background puzzle surface 10, as illustrated in FIG. 6. Portions of the background puzzle image 14 are visible through the transparent areas 28 of puzzle piece 20. As such, the user can realize that the initial placement of the puzzle piece 20 is incorrect, since the image areas 16 of the background puzzle image visible through transparent areas 28 do not match, or form a cohesive image together with, image areas 26 of the puzzle piece. The user may move puzzle piece 20 relative to background puzzle surface 10 until the image areas 26 of the puzzle piece and the image areas 16 of the background puzzle image 14 visible through transparent areas 28 of the puzzle piece match, or form a cohesive image which is a part of the source image 30. When such a match is achieved, the placement of the puzzle piece is correct, as indicated by reference numeral 62 in FIG. 6.

In some embodiments, when the user finds the correct placement of puzzle piece 20, he or she may remove the protective film 23 (illustrated in FIG. 2B) from the rear surface of the puzzle piece, and may press the puzzle piece 20 onto background puzzle surface 10, so as to adhere the puzzle piece onto the background puzzle surface at the correct location. Due to the low-tack nature of adhesive layer 22, the user may remove and reposition the puzzle piece 20 on the background puzzle surface 10, if desired.

If the puzzle piece 20 is not accurately placed by a user on the background puzzle surface in the correct location, thin lines may appear, such as white lines 64 illustrated in FIG. 6. These thin lines are portions of blank areas 18 of the background puzzle image visible through transparent areas 28 of puzzle piece 20 (in the illustrated example, color of blank areas 18 is white). It is appreciated that though these lines indicate inaccurate placement of the puzzle piece, the positioning of the puzzle piece is close to the correct one, and the image in the region covered by the puzzle piece 20 generally corresponds to the image in the corresponding region of source image 30.

It will be appreciated that multiple puzzle pieces 20 may be created as described hereinabove. For example, in some embodiments, the foreground puzzle image may be divided into a plurality of regions or portions in order to generate a plurality of puzzle piece images. Each such puzzle piece image can then be used to form a corresponding puzzle piece, such that each puzzle piece has a corresponding correct location on the background puzzle surface.

As described in further detail hereinbelow, in some embodiments a puzzle constructed according to the disclosed technology may be computerized. In such embodiments, the background puzzle image and puzzle piece image may be created as described hereinabove. However, these images would not be printed onto a physical background puzzle surface and a physical transparent puzzle piece as described hereinabove, but rather would be displayed and manipulated on a display screen.

Figure 3:
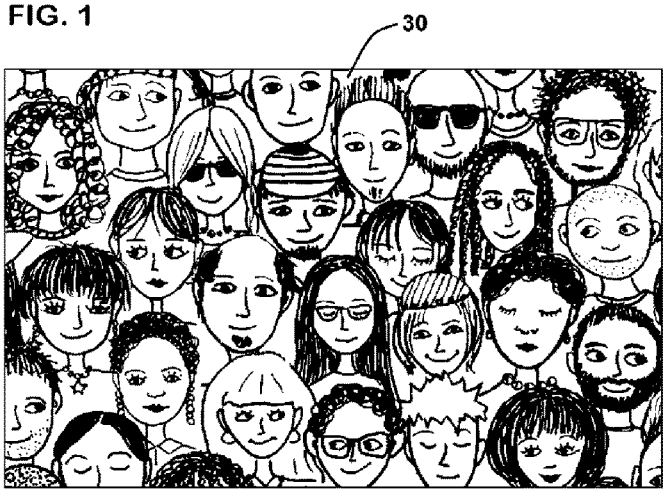
FIG. 3 illustrates a source image used to generate the background puzzle image of FIG. 1 and the puzzle piece image of FIG. 2A.
Figure 7A:
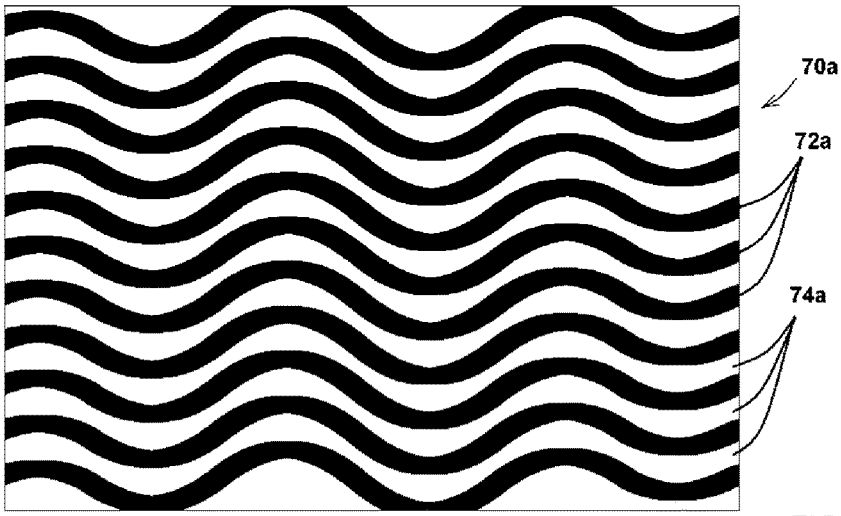
FIGS. 7A and 7B illustrate a mask and a complementary mask, respectively, which may be used to generate a background puzzle image and foreground puzzle image according to an embodiment of the disclosed technology.
Figure 7B:
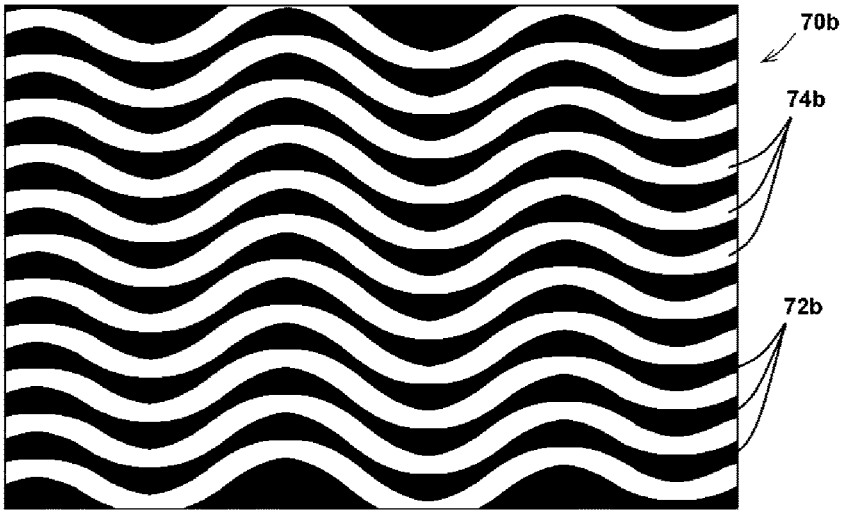
Figure 8:
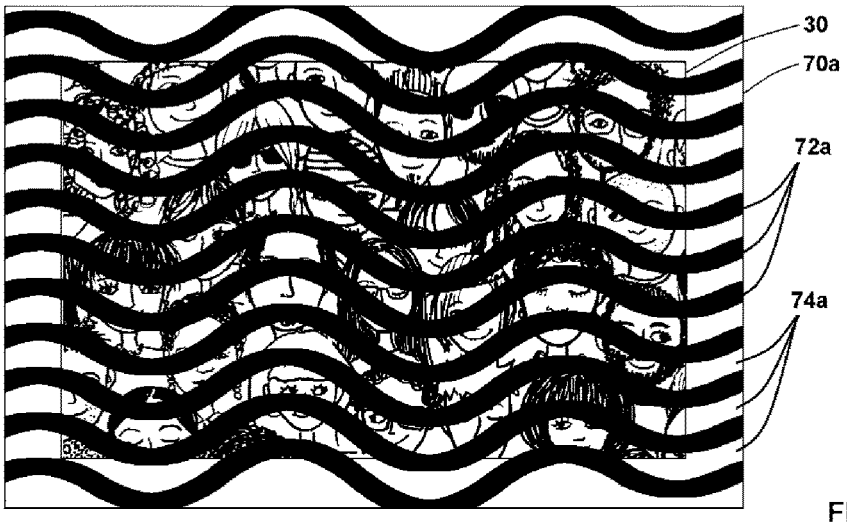
FIG. 8 illustrates the mask of FIG. 7A applied to the source image of FIG. 3.

Reference is now made to FIGS. 7A and 7B, which illustrate complementary masks which may be used to generate a background puzzle image and foreground puzzle image according to an embodiment of the disclosed technology, and to FIG. 8, which illustrates the mask of FIG. 7A applied to the source image 30 of FIG. 3. It will be appreciated that application of the complementary masks to the source image is a convenient way to divide the source image into two groups of sections and thereby to create the background and foreground puzzle images. Masked portions of the source image correspond to one group of sections while un-masked portions of the source image correspond to another group of sections. Application of a mask over an image is known in the art of image creation.

The masks of FIGS. 7A and 7B may be used to generate the background and foreground puzzle images as described hereinabove with respect to FIGS. 1 to 6, for example using a computer-based image editor such as Microsoft® Paint® software.

FIG. 7A illustrates a background mask 70*a*, having blocking regions 72*a* and unblocking regions 74*a*. FIG. 7B illustrates a foreground mask 70*b*, having blocking regions 72*b* and unblocking regions 74*b*. Masks 70*a* and 70*b* are complementary, such that blocking regions in mask 70*a* are unblocking in mask 70*b*, and vice versa. In the illustrated embodiment, the unblocking regions are colored in white. A color of the blocking regions in masks 70*a* and 70*b* is selected depending on colors of the source image: color of the blocking regions must not appear in the source image. For instance, if a source image is a black and white one, then color of the blocking regions in masks 70*a* and 70*b* may be, for instance, red. Or, if a source image is a multicolor one excluding black color, then color of the blocking regions in masks 70*a* and 70*b* may be black.

As specified hereinabove, the background mask 70*a* of FIG. 7A may be created in a computer-based image editor. The dimensions of mask are set to be slightly larger than those of the source image. The foreground mask 70*b* of FIG. 7B, which is complementary to the background mask, may then be created by flipping the colors of the background mask. If, for instance, colors of the blocking and unblocking regions of the background mask 70*a* are, respectively, red and white, then the foreground mask 70*b* may then be created from the background mask 70*a* in the image editor as following: substituting all occurrences of red color with blue (temporally, the color is selected by way of example), then all occurrences of white color with red and lastly, all occurrences of blue color with white.

The background puzzle image may then be generated by applying the background mask 70*a* to the source image 30, as illustrated in FIG. 8. This may be carried out using the computer-based image editor, for example by setting the image editor to "transparent" mode in which, when two images are superimposed, white color of the "upper" image appears transparent. Whit that setting, when the mask 70*a* is superimposed over the source image 30, areas of the source image covered by white unblocking regions 74*a* of the mask are presented and become the image areas of the background puzzle image. By contrast, areas of the source image covered by the blocking regions 72*a* are filled with the color of the blocking regions 72*a* which may be, for instance, red. The last step in creating the background puzzle image may be a substitution of the blocking regions' color in the resulting image with a pre-define color of the blank areas of the background puzzle image. As described hereinabove, the blank areas of the background puzzle image may have white color (as illustrated in FIG. 1) or any suitable color or a pattern.

Similarly, the foreground puzzle image may be generated using the computer-based image editor by applying the foreground mask 70*b* (complementary to mask 70*a*) to the source image 30. Then, a singular foreground puzzle image or a plurality of puzzle images may be created using the computer-based image editor by selecting a single region or a plurality of regions on the foreground puzzle image, essentially the same way as described hereinabove.

When generating the background and foreground puzzle images as described hereinabove, in both cases the background and foreground masks must be placed on the source image in the same position relatively to the source image, so as to ensure proper matching of the puzzle piece image to the background puzzle image.

Reference is now made to FIGS. 9A to 13, which illustrate another type of mask and corresponding background and foreground puzzle images as described hereinabove.

Figure 9A:
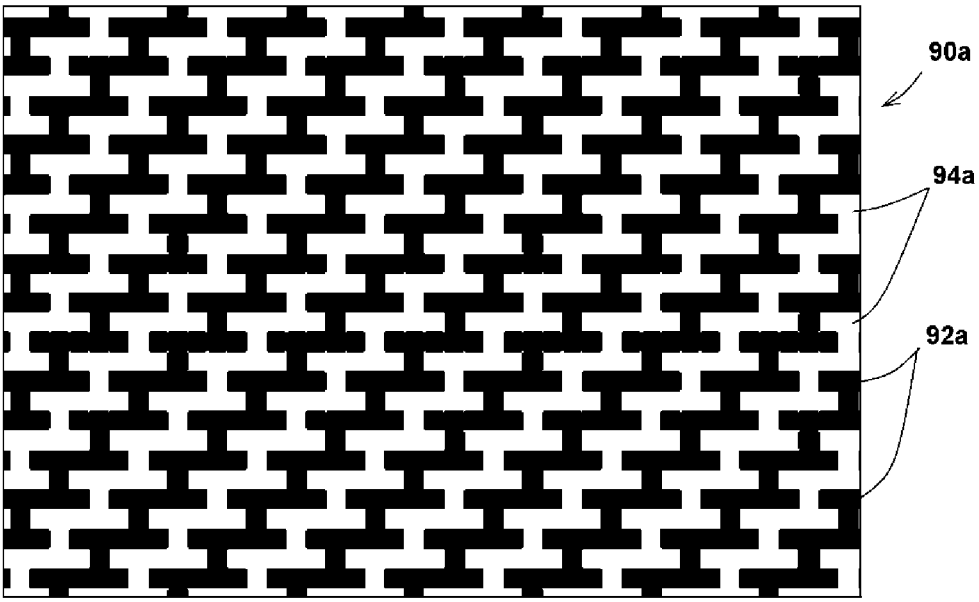
FIGS. 9A and 9B illustrate a mask and a complementary mask, respectively, which may be used to generate a background puzzle image and a foreground puzzle image according to the disclosed technology.
Figure 9B:
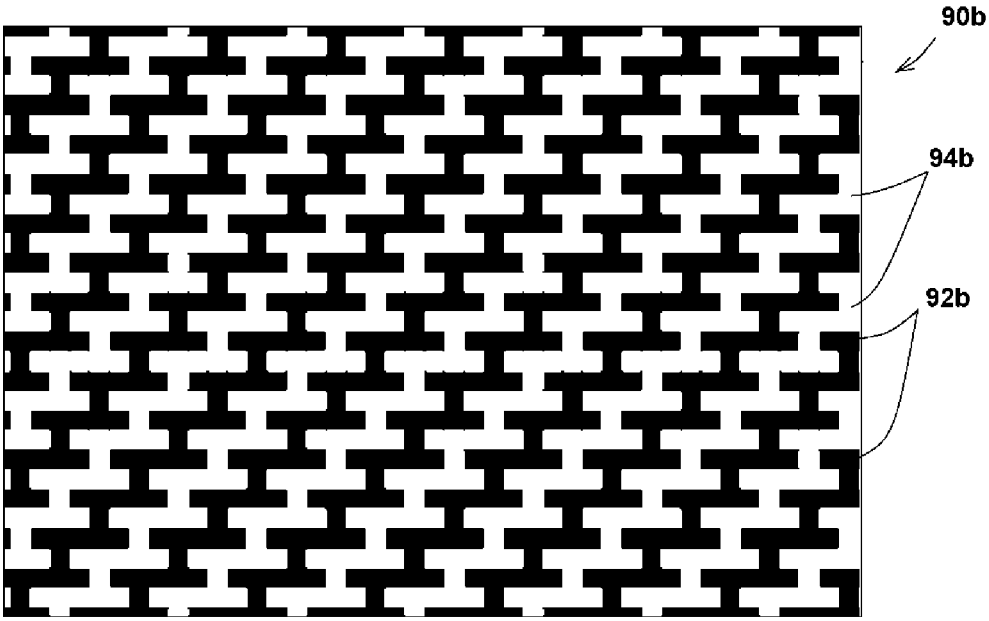

FIG. 9A illustrates a mask 90*a*, having blocking regions 92*a* and unblocking regions 94*a*. FIG. 9B illustrates a foreground mask 90*b*, having blocking regions 92*b* and unblocking regions 94*b*. Masks 90*a* and 90*b* are complementary, such that blocking regions in mask 90*a* are unblocking in mask 90*b*, and vice versa, substantially as described hereinabove with reference to masks 70*a* and 70*b* of FIGS. 7A and 7B. In the illustrated embodiment, blocking regions are colored in black, and unblocking regions are colored in white. However, any other colors may be selected for the blocking and unblocking regions.

Figure 10A:
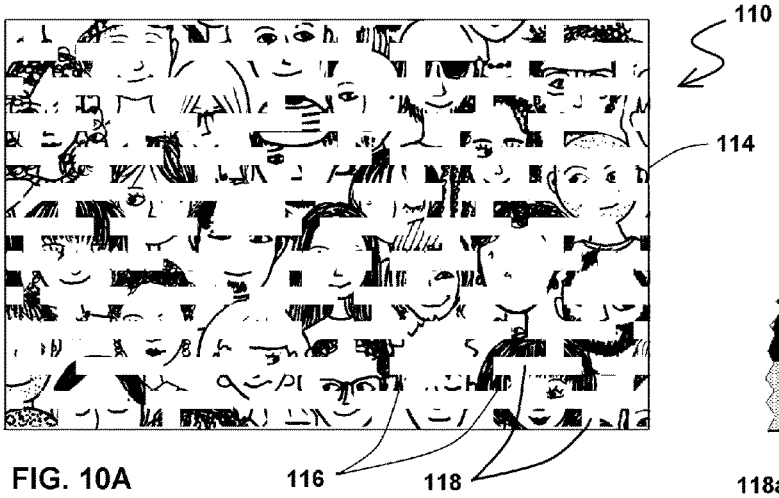
FIGS. 10A and 10B illustrate a background puzzle image and a foreground puzzle image generated using the source image of FIG. 3 and the masks of FIGS. 9A and 9B, respectively.
Figure 10B:
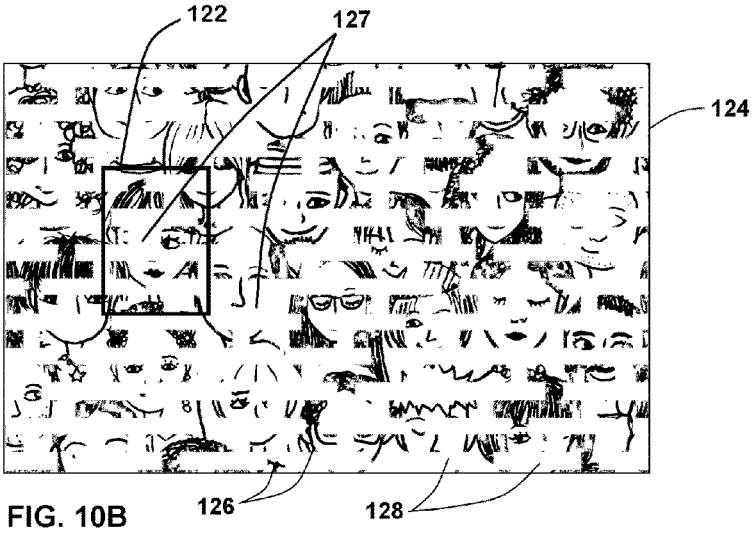

FIGS. 10A and 10B illustrate a background puzzle image 114 and a foreground puzzle image 124. The background puzzle image 114 is generated by applying background mask 90*a* to source image 30 of FIG. 3, substantially as described hereinabove. As described hereinabove, the background puzzle image 114 includes image areas 116 corresponding to unblocking regions 94*a* of mask 90*a*, and blank areas 118 corresponding to blocking regions 92*a* of mask 90*a*. The background puzzle image may be printed onto a surface to form a background puzzle surface 110, as described hereinabove with reference to FIGS. 1 to 6.

Similarly, the foreground puzzle image 124 in FIG. 10B is generated by applying background mask 90*b* to source image 30 of FIG. 3, substantially as described hereinabove. As described hereinabove, the foreground puzzle image 124 includes image areas 126 corresponding to unblocking regions 94*b* of mask 90*b*, and blank areas 128 corresponding to blocking regions 92*b* of mask 90*b*. In the described embodiment of the puzzle, color of the blank areas 128 is white.

Figure 11:
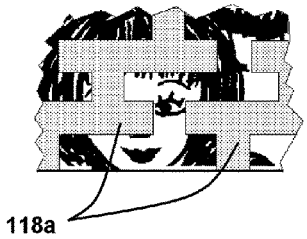
FIG. 11 shows a portion of the background puzzle image of FIG. 10A, where the blank areas are filled with a predetermined pattern.

Reference is now made to FIG. 11, which illustrates a portion of the background puzzle image of FIG. 10A. As seen, in some embodiments, the blank areas 118*a* of the background puzzle image 114 may be filled with a predetermined color or with a pattern, monochrome or multicolored.

It will be appreciated that in some embodiments, the blank areas 118 of the background puzzle image 114 may be filled with portions of a second source image, which is different from the source image 30. In another embodiments, the blank areas 118 may be filled with portions of the source image 30 so that location these portions on the source image do not correspond to location of the blank areas 118. In still another embodiments, the blank areas 118 may be filled with portions of the source image 30 which were rotated relatively to their original orientation. These embodiments would add complexity to the puzzle solving.

Figure 12A:
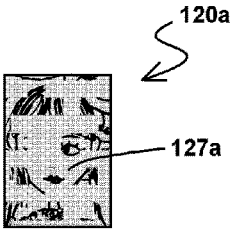
FIGS. 12A and 12B illustrate a puzzle piece generated from the foreground puzzle image of FIG. 10B, where in FIG. 12B blank areas of the puzzle piece image have visible borders.

Reference is now made to FIG. 12A which illustrates a puzzle piece 120*a* generated from the foreground image 124 of FIG. 10B. Similar to the embodiment illustrated in FIG. 5, image of the puzzle piece 120*a* is based on a region, or portion of foreground puzzle image 124, indicated in FIG. 10B by reference numeral 122. Similar to the puzzle piece described hereinabove with reference to FIG. 2A, the puzzle piece 120*a* includes image areas and transparent areas. In the current embodiment, color of blank areas 128 of the foreground image 124 is white. If background of the source image 30 is white as well, then the foreground image 124 appears to have extended blank areas (or, in some cases one continuous area), indicated by reference numeral 127. In the extended blank areas 127 there are no visible borders between white portions of image area 126 and adjacent blank areas 128. When the puzzle piece is printed or otherwise disposed on the puzzle piece 120*a*, the extended blank areas 127 in the region 122 of the foreground puzzle image 124 become an extended transparent area 127*a* of the puzzle piece. (For purpose of illustration, extended transparent area 127*a* is filled with small dots pattern in FIG. 12A). The extended transparent area/areas is/are transparent, similarly to the transparent areas of the puzzle piece described hereinabove with reference to FIGS. 1 to 6.

Figure 12B:
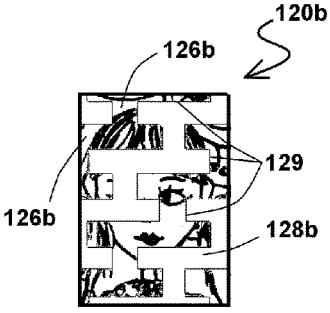

FIG. 12B illustrates another embodiment of the teachings herein. Similar to the puzzle piece 120*a*, a puzzle piece 120*b* is generated from the foreground image 124 based in the region 122 thereof. However, transparent areas 128*b* of the puzzle piece 120*b* have visible borders 129. White portions of the image areas 126*b* of the puzzle piece 120*b* may be transparent or in some embodiments may bear white color. Similarly, blank areas 118 of the background puzzle image 114 on FIG. 10A may have visible borders in some embodiments.

Figure 13:
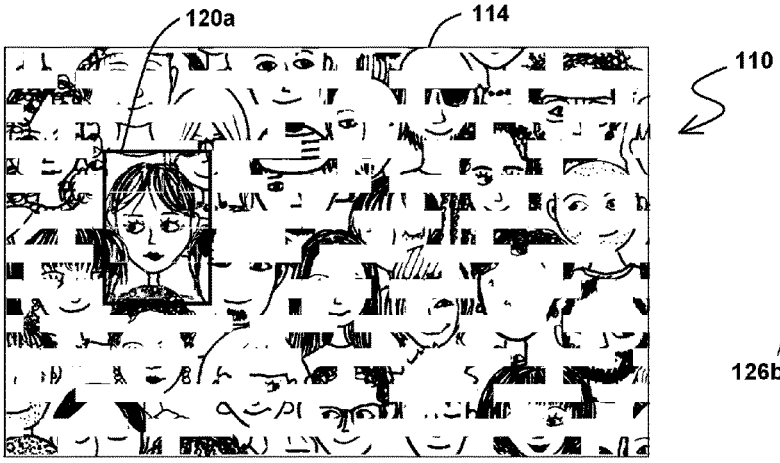
FIG. 13 illustrates the puzzle piece of FIG. 12A superimposed on a background puzzle surface of FIG. 10A.

Turning to FIG. 13, it is seen that puzzle piece 120*a* can be positioned and oriented on the surface of the background puzzle 110 until a correct position thereof is found, substantially as described hereinabove with respect to FIGS. 5 and 6.

Figure 14:
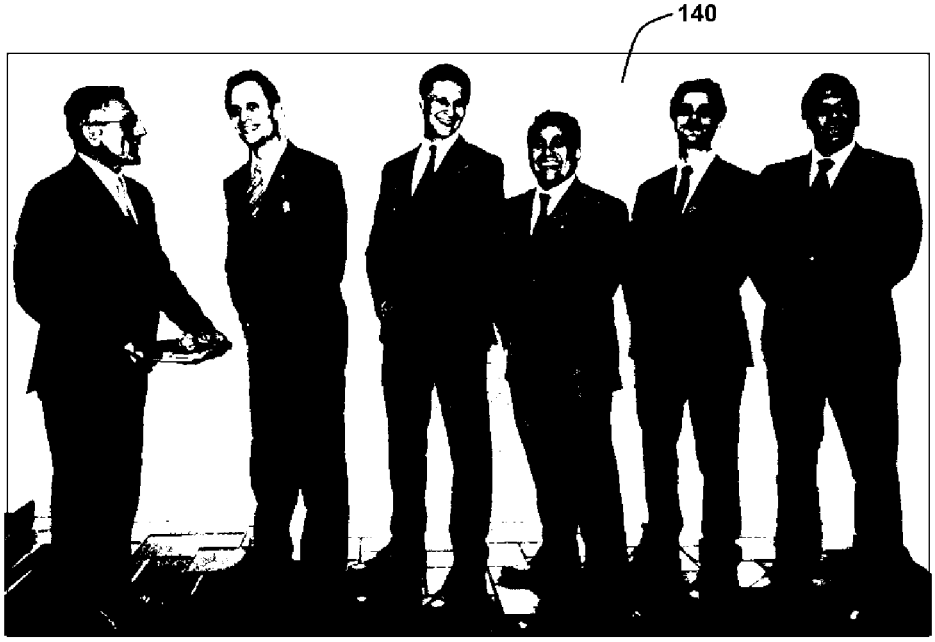
FIG. 14 illustrates another source image to be turned into a puzzle according to the disclosed technology.

Reference is now made to FIGS. 14 to 17, which illustrate another embodiment of the teachings herein. FIG. 14 illustrates a source image 140 used to generate a puzzle according to the teachings herein. FIGS. 15A and 15B illustrate, respectively, a background puzzle image 152 and a foreground puzzle image 154 generated from the second source image 140, by application thereto the background mask 70*a* and the foreground mask 70*b* of FIGS. 7A and 7B, substantially as described hereinabove with reference to FIGS. 7A to 8. As described hereinabove, the background puzzle image may be printed onto a suitable substrate or surface to form a background puzzle surface 150.

Figure 15A:
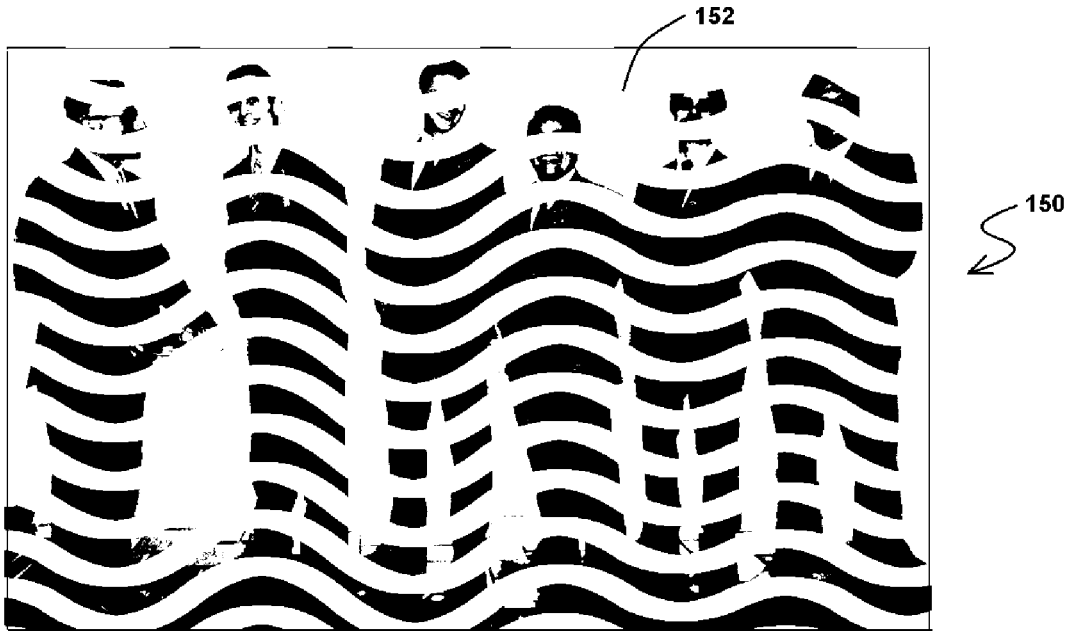
FIGS. 15A and 15B illustrate a background puzzle image and a corresponding foreground puzzle image generated from the source image of FIG. 14.
Figure 15B:
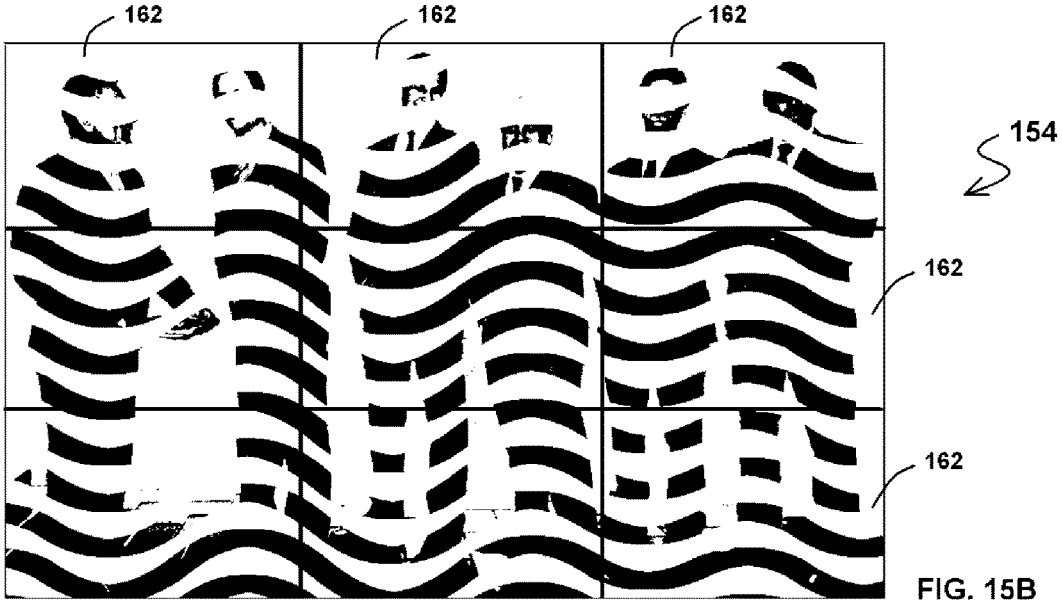
Figure 16A:
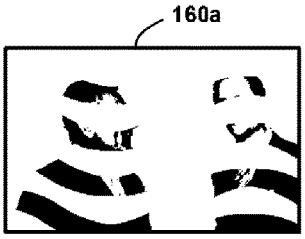
FIGS. 16A, 16B, and 16C illustrate puzzle piece images generated from the foreground puzzle image of FIG. 15B.
Figure 16B:
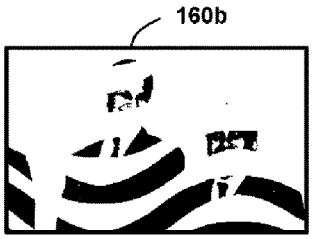
Figure 16C:
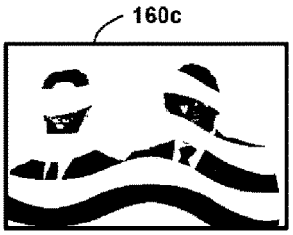

As seen in FIG. 15B, the entirety of the foreground puzzle image 154 is divided into regions 162. At least some, and preferably each, of regions 162 is used to generate a separate puzzle piece image, and to generate therefrom a corresponding puzzle piece, such as puzzle pieces 160*a*, 160*b*, and 160*c* of FIGS. 16A to 16C, respectively, substantially as described hereinabove. It will be appreciated that any suitable number of regions 162 may be used in accordance with the teachings herein.

Figure 17:
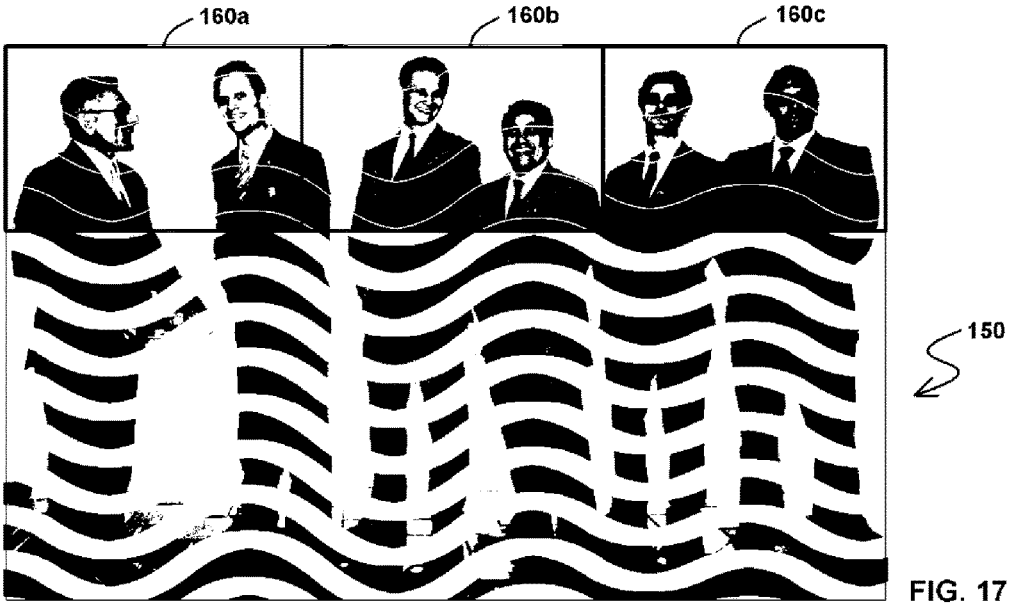
FIG. 17 illustrates a puzzle including the background puzzle image of FIG. 15A, partially solved by the puzzle piece images of FIGS. 16A, 16B, and 16C.

A user solving the puzzle of FIGS. 14 to 17 would receive multiple puzzle pieces, each corresponding to a different region of the source image, and would have to place correctly the puzzle pieces on the background puzzle surface in order to solve the puzzle. FIG. 17 illustrates a partial solution of the puzzle using puzzle pieces 160*a*, 160*b*, and 160*c* of respective FIGS. 16A to 16C. A separate puzzle piece is formed corresponding to each of the regions 162, such that the user would have to cover the entirety of the background puzzle surface 150 with puzzle pieces each including a puzzle piece image corresponding to one of regions 162. In such embodiments, the image appearing on the completed accurately puzzle would be identical to the source image, which in the illustrated embodiment is the source image 140.

Figure 18:
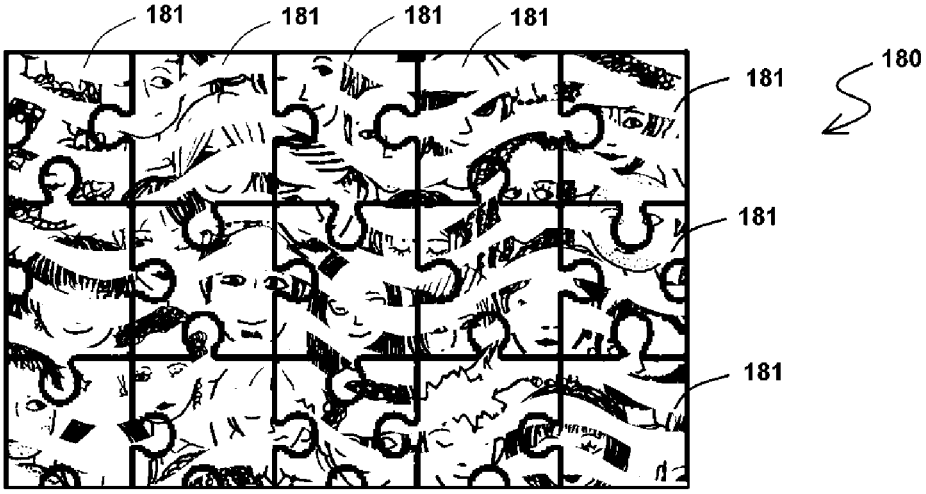
FIG. 18 illustrates a foreground puzzle image divided into puzzle piece images according to the disclosed technology.

Reference is now made to FIG. 18, which illustrates a foreground puzzle image divided into puzzle piece image regions according to the disclosed technology. As seen in FIG. 18, a foreground puzzle image 180 is divided into a plurality of regions 181. In the illustrated embodiment, different regions 181 have different shapes. As seen, the contours of the regions 181 all match each other, so that there is no overlap or gaps between regions 181. It will be appreciated that regions 181 may have any suitable shapes, such as, for example, hexagonal shapes forming a honeycomb pattern, or any other suitable shapes, provided that the contours of adjacent regions match each other.

Figure 19A:
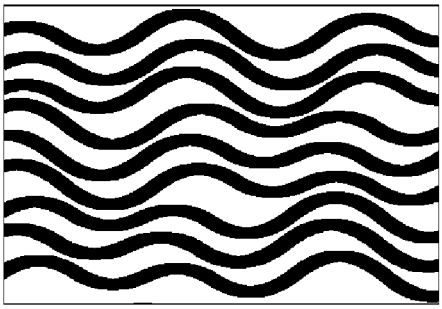
FIGS. 19A and 19B illustrate additional types of masks according to embodiments of the disclosed technology.
Figure 19B:
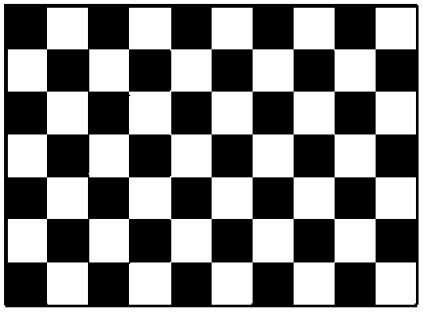

FIGS. 19A and 19B illustrate additional types of masks which may be used to generate a background puzzle image and a foreground puzzle image and corresponding puzzle piece image/images according to embodiments of the disclosed technology, as described hereinabove. The mask of FIG. 19A is irregular. The mask of FIG. 19B is a checkerboard shaped mask, wherein none of the sections cover the entire height or width of the mask. It is appreciated that use of masks such as those illustrated in FIGS. 19A and 19B may impact the difficulty level of a puzzle generated using the mask. For example, a puzzle generated using the irregular mask of FIG. 19A would be more difficult to solve than a puzzle generated using the mask 90*a* of FIG. 9A, due to the fact that with the mask of FIG. 9A the shapes of the corresponding image areas and the blank areas of the puzzle surface and the puzzle piece may contribute to the identification of the correct placement of the puzzle piece. Similarly, the type of source image used to generate the puzzle may impact the difficulty level of the puzzle.

Figure 20:
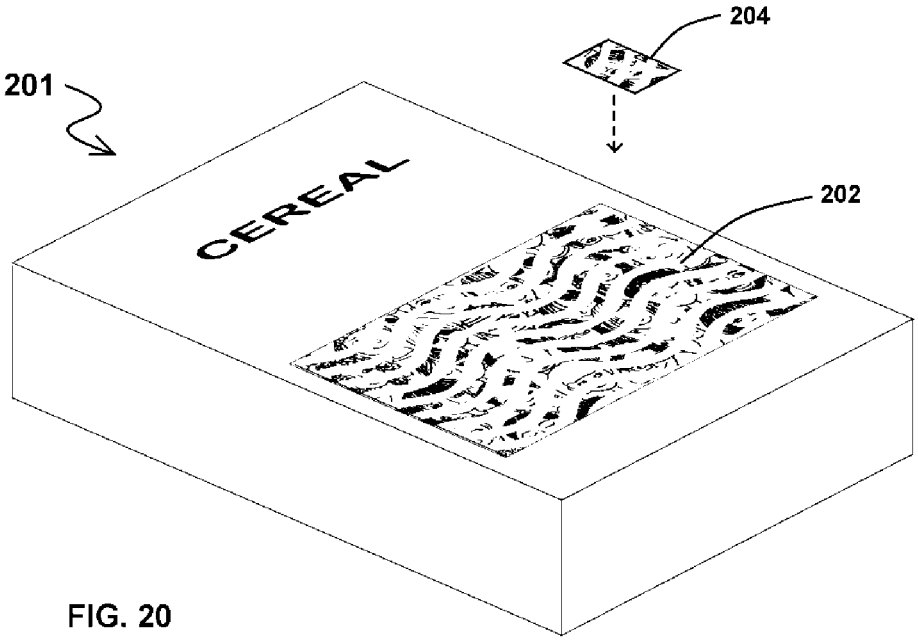
FIG. 20 illustrates an implementation of a puzzle according to the disclosed technology on a cardboard box.

FIG. 20 illustrates an implementation of a puzzle according to the disclosed technology on a cardboard box, such as a cereal box. As seen, box 201 has a background puzzle image 202 printed directly thereon. A corresponding transparent puzzle piece 204, substantially as described hereinabove, is illustrated above the box 201. The user solves the puzzle by correctly placing the piece 201 on the background puzzle image 202 printed on the box, substantially as described hereinabove. In some embodiments, the puzzle piece 204 may be provided to the user within the box 201, or removably attached to an exterior thereof.

Figure 21:
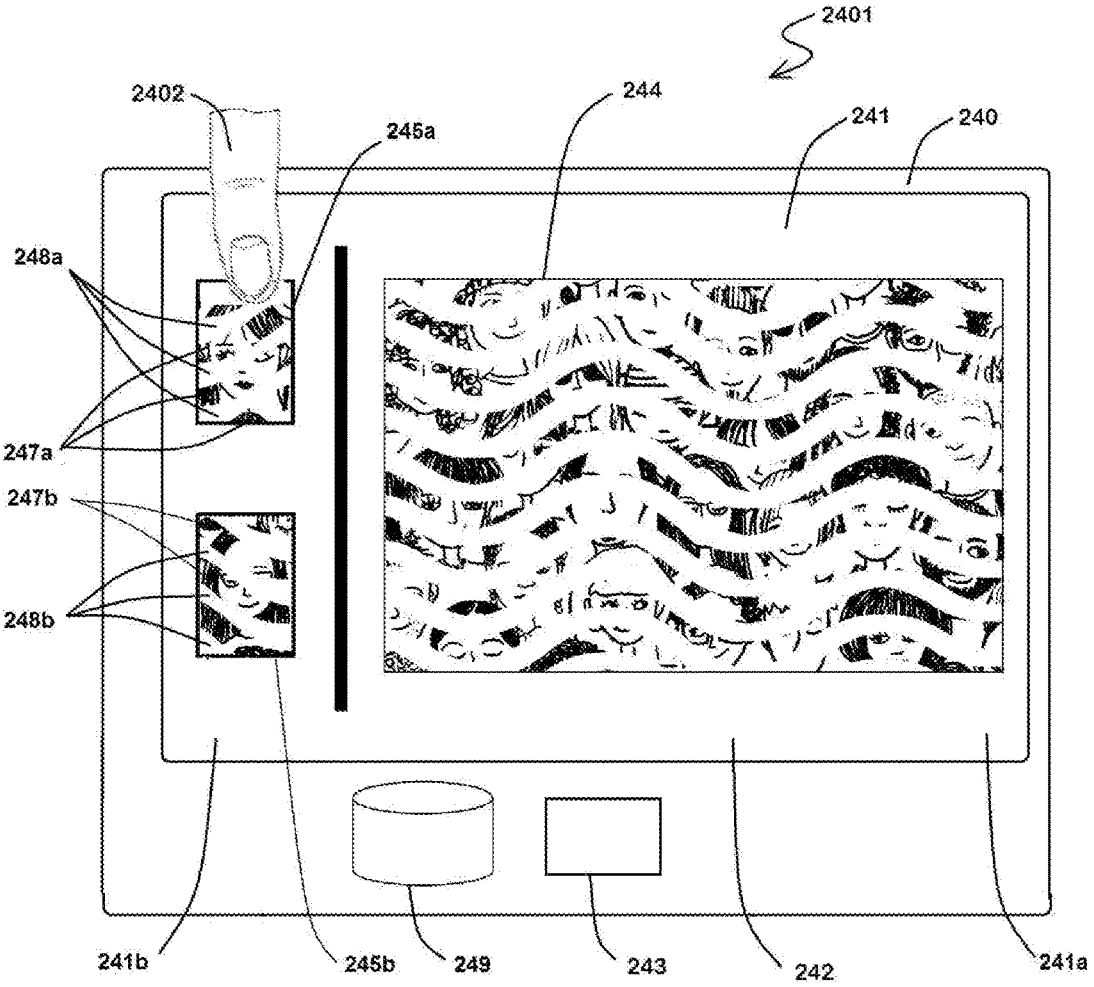
FIG. 21 illustrates a computerized implementation of a puzzle according to the disclosed technology.

FIG. 21 illustrates a computerized implementation of a puzzle 2401 according to the disclosed technology. As seen in FIG. 21, a hand-held electronic device 240 includes a display screen 241, a user input mechanism 242, and a processor 243. The processor 243 is adapted to receive input from the user, for example via user input mechanism 242, and to change or manipulate the images displayed on display screen 241. In the illustrated embodiment, the display screen 241 is a touch screen, and therefore can also function as the user input mechanism 242. In some embodiments, the user input mechanism can be implemented separately from the display screen. It will be appreciated that any suitably equipped computing device may be used in place of device 240, including a desktop computer, a laptop computer, a tablet computer, a smartphone, and the like.

As seen in FIG. 21, the device 240 may implement the puzzle 2401 as described hereinabove. Specifically, a background puzzle image 244 as well as puzzle pieces 245*a* and 245*b* are displayed on the display screen 241. As taught hereinabove, the background puzzle image 244 includes image areas 246*a*, and includes blank areas 246*b* which may be filled with a color, a pattern, or portions of an image. The puzzle pieces 245*a* and 245*b* include image areas 247*a* and 247*b*, respectively, and include transparent areas 248*a* and 248*b*, respectively.

The images 244, 245*a*, and 245*b* preferably are provided to the processor 243 as pre-formed images, however, in some embodiments may be generated by the processor 243. The images 244, 245*a*, and 245*b* may be stored in binary format in a storage medium 249 functionally associated with the processor 243, to be accessed by the processor 243, or may be transferred to the processor 243 from a remote location, such as a server, via a suitable data network, such as the Internet.

In some embodiments, such as the illustrated embodiment, the background puzzle image is displayed in a first portion 241*a* of the display screen and the puzzle pieces are initially displayed in a second portion 241*b* of the display screen.

The processor 243 is configured so that a user may provide user input moving the puzzle pieces 245*a* and 245*b* relative to background puzzle image 244 on the screen, so as to superimpose the puzzle pieces over the background puzzle image 244. In the illustrate embodiment, the display screen 241 is a touch screen, and the user provides instructions to move puzzle piece 245*a* by touching the display screen in the location thereof with his or her finger 2402, and pulling the puzzle piece to a desired location. In some embodiments, the background puzzle image may be moved in a desired location to superimpose the puzzle pieces.

Processor 243 is configured such that when a puzzle piece, such as puzzle piece 245*a*, is superimposed over the background puzzle image 244, the screen 241 displays, in the area of superimposition, images areas 247*a* of the puzzle piece, and image areas 246*a* of the background puzzle image visible through transparent blank areas 248*a* of the puzzle piece. Outside of the area of superimposition, the screen displays corresponding portions of the puzzle piece and the background puzzle image. This is a computer-based equivalent to the tangible puzzle as described hereinabove with reference to FIGS. 1 to 6.

To solve the puzzle, the user must find the correct location for each puzzle piece, substantially as described hereinabove with reference to FIGS. 4 to 6, such that the image displayed by the screen in the area of superimposition is identical to a corresponding area of the source image, for example source image 30 of FIG. 3. In some embodiments, once the puzzle piece is correctly placed on the background puzzle image, the location of the puzzle piece relative to the background puzzle image is "locked", or becomes fixed, such that the puzzle piece cannot be moved relative to the background puzzle image. This is equivalent to sticking the tangible puzzle piece onto the background puzzle surface, as described hereinabove with reference to FIGS. 1 to 6.

In some embodiments, the processor 243 may allow the user to select characteristics of the puzzle 2401. In some such embodiments, the user may be allowed to select desired images from a collection of available background puzzle images and puzzle pieces, so essentially to select a puzzle from a collection of available puzzles. In some embodiments, the user may select the number of puzzle pieces to be placed in order to solve the puzzle, or the shape(s) of the puzzle pieces. In some embodiments, the user may be allowed to rotate the images (essentially, to change orientation of the puzzle pieces and/or background puzzle image on the display screen), not just to move the images on the display screen.

FIG. 21 illustrates two rectangular puzzle pieces on the display screen. It will be appreciated that any suitable number of the puzzle pieces may be presented at a particular time on the display screen. Also, the background puzzle image and the puzzle pieces may assume any suitable shapes.

Figure 23:
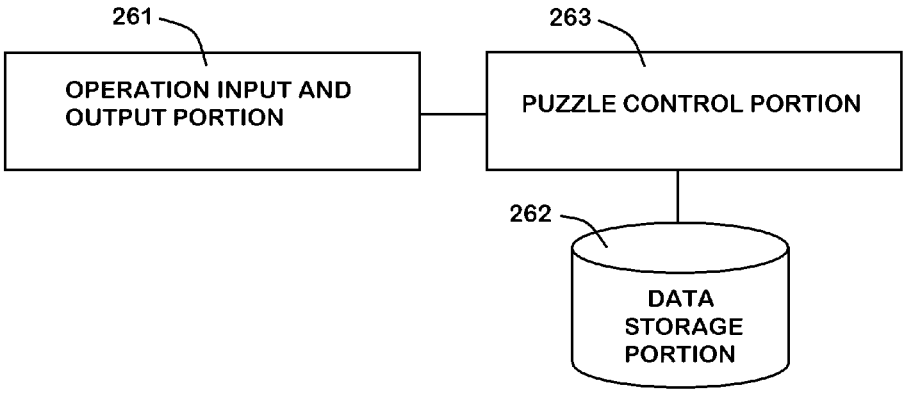
FIG. 23 illustrates an exemplary hardware configuration suitable for implementing a computerized embodiment of the disclosed technology.

Reference is now made to FIG. 23, which illustrates an exemplary hardware configuration suitable for implementing a computerized embodiment of the disclosed technology, such as the embodiment shown in FIG. 21. The hardware configuration, which is equivalent to the hardware of device 240 of FIG. 21, includes an operation input and output portion 261 configured to accept input from the user relating to desired operations and to display the related images, buttons and alike, a data storage portion 262, and a puzzle control portion 263 adapted to control processes and programs executed with respect to the displayed puzzle. The puzzle control portion 263 comprises a CPU and a storage medium such as a RAM, a ROM, and the like, required for operations of the CPU.

The operations input and output portion 261 includes screen 241 and user input mechanism 242 of FIG. 21. Storage portion 262 stores the computer programs code including instructions to be implemented by the processor or CPU, as well as data relating to the images utilized in the puzzle. Puzzle control portion 263 accepts inputs from the operation input portion 261, such as user inputs provided via the user input mechanism 242, to move the puzzle pieces and/or background puzzle image, and executes instructions to display the resulting images on the screen, and various kinds of related processes. Storage portion 262 may be local to the puzzle control portion 263, or may be remote therefrom and connected thereto via a data network, for instance the Internet.

Figure 24:
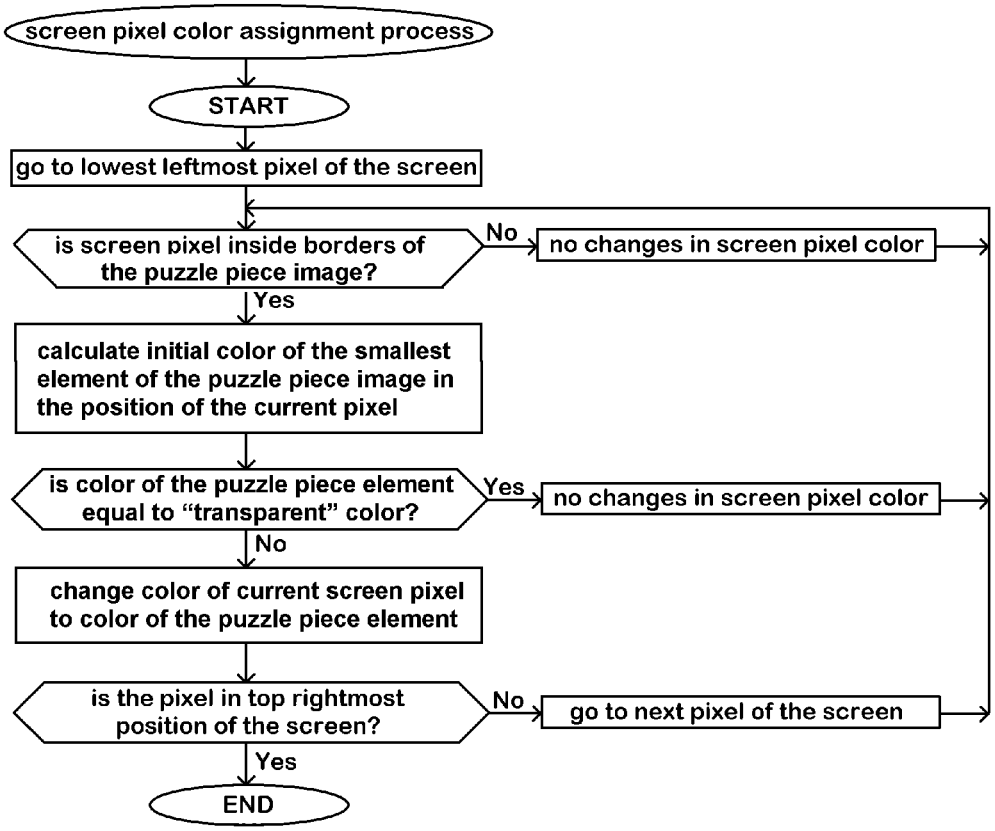
FIG. 24 is a flow chart of a method carried out by computer software implementing a computerized embodiment of the disclosed technology.

The instructions, or program, to generate and display the resulting images on the screen, which executed by the CPU of puzzle control portion 263, are illustrated in the flow chart of FIG. 24. According to these instructions, the processor instructs the display screen pixels what colors should be presented, such that when the user moves a piece on the screen, the color displayed by each pixel is calculated using the flow chart of FIG. 24. As such, these instructions are executed after each movement of a puzzle piece or a background puzzle image on the screen.

The program initiates at the lowest leftmost pixel of the screen and loops through each pixel, until it reaches the top rightmost pixel of the screen. For each pixel, the program evaluates if the current screen pixel is inside the borders of the puzzle piece. If the answer is negative, then the program does not change the color of the current screen pixel. If the answer is positive, the program calculates the color of the puzzle piece element which occurs in the position of the current pixel, using methods known in the art of image processing. For instance, the puzzle piece image may be stored and processed in bitmap format. In that format the image is coded as two-dimensional pixel array where each value of the array presents the color of a particular pixel. Width of the array is equal to width of the image, measured in pixels; number of rows of the array is equal to height of the image, measured in pixels as well. In order to get the color of the puzzle piece element, the program calculates position of the current pixel of the screen in the image's pixel array and retrieves the value of the array for the found position.

If the color of the puzzle piece element is equal to "transparent" (in FIG. 24, the "transparent" color is illustrated as white), then the program does not change color of the current screen pixel, such that the "underlying" pixel is "visible" through the transparent area of the puzzle piece, be it a pixel of the background puzzle image, or a pixel anywhere else on the screen. By contrast, if the color of the puzzle piece element is not "transparent", the program changes color of the current screen pixel to the color of the puzzle piece element, such that the "underlying" pixel is covered by the image area of the puzzle piece.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method for creating a puzzle, the method comprising:

obtaining a source image;

dividing said source image into a plurality of adjacent, spatially non-overlapping sections, each section including all details included in a corresponding area of said source image;

dividing said plurality of sections into first and second groups of sections with each said group including at least one section of said plurality of sections;

generating a background puzzle image, said background puzzle image including image areas corresponding to areas of said source image included in sections of said first group of sections and entirely blank areas corresponding to areas of said source image included in each of the sections of said second group of sections;

generating a foreground puzzle image, said foreground puzzle image including image areas corresponding to areas of said source image included in sections of said second group of sections and entirely blank areas corresponding to areas of said source image included in each of the sections of said first group of sections;

generating at least one puzzle piece image by selecting at least one region on said foreground puzzle image as said at least one puzzle piece image, such that blank areas of said at least one puzzle piece image correspond to blank areas of said foreground puzzle image confined in said at least one region;

creating a unitary background puzzle surface having said background puzzle image provided thereon; and creating, from a transparent material, at least one puzzle piece having said at least one puzzle piece image provided thereon wherein said blank areas of puzzle piece image provide transparent areas in said at least one puzzle piece, wherein, when said at least one puzzle piece is placed overlying said background puzzle surface in a particular location with a particular orientation, said puzzle piece image together with the image areas of said background puzzle image on said background puzzle surface, visible through said transparent areas in said at least one puzzle piece, form an image generally identical to a portion of said source image.

2. The method of claim 1, wherein said background puzzle surface has background puzzle surface dimensions, and wherein said generating at least one puzzle piece comprises generating each of said at least one puzzle piece to have dimensions at least two times smaller than said background puzzle surface dimensions.

3. The method of claim 1, wherein said creating said unitary background puzzle surface comprises providing an entirety of said background puzzle image on a surface of a unitary flat sheet.

4. The method of claim 1, wherein said creating said at least one puzzle piece comprises creating said at least one puzzle piece from a transparent sheet having said at least one puzzle piece image on at least one surface thereof.

5. The method of claim 4, wherein said creating said at least one puzzle piece comprises creating said at least one puzzle piece having an adhesive layer on said at least one surface.

6. The method of claim 1, wherein said generating said background puzzle image comprises filling said blank areas of said background puzzle image with a predetermined color or a predetermined pattern.

7. The method of claim 1, wherein said generating said background puzzle image comprises filling said blank areas of said background puzzle image with portions of a second source image, said second source image being different from said source image.

8. The method of claim 1, wherein said creating said at least one puzzle piece comprises creating said at least one puzzle piece from a transparent sheet having a first broad surface and an opposing broad surface parallel to said first broad surface, placing an image corresponding to a mirror-reversed copy of said at least one puzzle piece image on said first surface of said at least one puzzle piece, thereby, when looked through said opposing surface of said at least one puzzle piece, said image appears as said at least one puzzle piece image.

9. A method for creating a puzzle, the method comprising:

obtaining a source image, said source image is confined within a source image area;

dividing said source image area into a plurality of non-overlapping sections;

dividing said plurality of sections into first and second groups of sections, each group including at least one section of said plurality of sections;

generating a background puzzle image mask, said background puzzle image having image areas corresponding to each of said sections of said first group of sections and including image content thereof, and entirely blank areas corresponding to each of said sections of said second group of sections excluding all image content thereof;

generating a foreground puzzle image mask, said foreground puzzle image having image areas corresponding to each of said sections of said second group of sections and including image content thereof, and entirely blank areas corresponding to each of said sections of said first group of sections excluding all image content thereof;

generating at least one puzzle piece image by selecting at least one region on said foreground puzzle image mask as said at least one puzzle piece image, wherein entirely blank areas of said puzzle piece image correspond to said blank areas of the foreground puzzle image confined within said at least one region;

creating a background puzzle surface having said background puzzle image mask provided thereon; and creating, from a transparent material, at least one puzzle piece having a surface and providing thereupon one of the following:

(i) said at least one puzzle piece image;

(ii) a mirror-reversed copy of said at least one puzzle piece image, wherein said entirely blank areas of puzzle piece image provide transparent areas in said at least one puzzle piece, thereby, when said at least one puzzle piece is placed upon said background puzzle surface in a particular location with a particular orientation, said at least one puzzle piece image does not overlap image areas of said background puzzle image mask, and said at least one puzzle piece image together with the image areas of said background puzzle image mask on said background puzzle surface, visible through said transparent areas in said at least one puzzle piece, form an image generally identical to a portion of said source image.

10. The method of claim 9, wherein said background puzzle surface has background puzzle surface includes an entirety of said background image puzzle mask and has background puzzle surface dimensions, and wherein said generating at least one puzzle piece comprises generating each of said at least one puzzle piece to have dimensions at least two times smaller than said background puzzle surface dimensions.

11. The method of claim 9, wherein said creating said at least one puzzle piece comprises creating said at least one puzzle piece from a transparent sheet having a front surface and a rear surface.

12. The method of claim 11, wherein said creating said at least one puzzle piece comprises providing said at least one puzzle piece image on said front surface of the transparent sheet.

13. The method of claim 11, wherein said creating said at least one puzzle piece comprises providing said mirror-reversed copy of said at least one puzzle piece image on said rear surface of the transparent sheet, thereby, when looked through said front surface of the transparent sheet, the image appears as said at least one puzzle piece image.

14. The method of claim 9, wherein said generating said background puzzle image mask comprises filling said blank areas of background puzzle image mask with one of the following:

(i) a predetermined color;

(ii) a predetermined pattern;

(iii) portions of a second source image, different from said source image;

(vi) portions of said source image, said portions being non-identical to portions of said source image included in corresponding sections of said second group of sections.

15. The method of claim 9, wherein sections of said second group of sections consist of portions of said source image area which are spatially complementary to sections of said first group of sections.

16. A method for creating a puzzle, the method comprising:

obtaining a source image;

dividing said source image into a plurality of adjacent, non-overlapping, sections;

dividing said plurality of adjacent sections into first and second groups of sections, each of said first and second groups of sections including at least one section of said plurality of sections;

generating a background puzzle image, by:

defining an area of said background puzzle image;

copying said source image into said area of said background puzzle image, while keeping the division of said source image into said plurality of adjacent sections;

blanking out image content of said source image in sections of said area of said background puzzle image corresponding to each of said sections of said second group of sections, to form blank areas of said background puzzle image, said blank areas being entirely blank; and creating a unitary background puzzle surface having said background puzzle image disposed thereon;

generating a foreground puzzle image by:

defining an area of said foreground puzzle image;

copying said source image into said area of said foreground puzzle image;

blanking out image content of said source image in sections of said area of said foreground puzzle image corresponding to each of said sections of said first group of sections, to form blank areas of said foreground puzzle image, said blank areas being entirely blank;

generating at least one puzzle piece image by selecting at least one region on said foreground puzzle image as said at least one puzzle piece image, blank areas of said puzzle piece image corresponding to said blank areas of the foreground puzzle image confined within said at least one region;

and creating, from a transparent material, at least one puzzle piece having a surface and providing thereupon one of the following:

(i) said at least one puzzle piece image;

(ii) a mirror-reversed copy of said at least one puzzle piece image, wherein said blank areas of said puzzle piece image provide transparent areas in said at least one puzzle piece, thereby, when said at least one puzzle piece is placed upon said background puzzle surface in a particular location with a particular orientation, said at least one puzzle piece image does not overlap image areas of said background puzzle image, and said at least one puzzle piece image together with the image areas of said background puzzle image on said background puzzle surface, visible through said transparent areas in said at least one puzzle piece, form an image generally identical to a portion of said source image.

17. The method of claim 16, wherein said creating said unitary background puzzle surface comprises providing an entirety of said background puzzle image on a surface of a unitary flat sheet.

18. The method of claim 16, wherein said creating said at least one puzzle piece comprises creating said at least one puzzle piece from a transparent sheet having a front surface and a rear surface and providing said at least one puzzle piece image on the front surface of the transparent sheet.

19. The method of claim 16, wherein said creating said at least one puzzle piece comprises creating said at least one puzzle piece from a transparent sheet having a front surface and a rear surface and providing said mirror-reversed copy of said at least one puzzle piece image on the rear surface of the transparent sheet, thereby, when looked through the front surface of the transparent sheet, the image appears as said at least one puzzle piece image.

* * * * *